US007396301B2

(12) United States Patent
Ohama et al.

(10) Patent No.: US 7,396,301 B2
(45) Date of Patent: Jul. 8, 2008

(54) GOLF BALL

(75) Inventors: Keiji Ohama, Kobe (JP); Kazuhiko Isogawa, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 25 days.

(21) Appl. No.: 11/508,955

(22) Filed: Aug. 24, 2006

(65) Prior Publication Data

US 2007/0049421 A1 Mar. 1, 2007

(30) Foreign Application Priority Data

Aug. 25, 2005 (JP) ..... 2005-245017
Aug. 25, 2005 (JP) ..... 2005-245018

(51) Int. Cl.
*A63B 37/06* (2006.01)

(52) U.S. Cl. ..... 473/373

(58) Field of Classification Search ..... 473/373, 473/377

See application file for complete search history.

(56) References Cited

U.S. PATENT DOCUMENTS 5,902,192 A 5/1999 Kashiwagi et al.
5,935,021 A 8/1999 Kashiwagi et al.
6,012,991 A * 1/2000 Kim et al. ..... 473/374
6,794,447 B1 9/2004 Kim et al.
2002/0022537 A1 2/2002 Nesbit et al.
2007/0026972 A1 * 2/2007 Isogawa et al. ..... 473/378
2007/0173350 A1 * 7/2007 Ohama et al. ..... 473/371

FOREIGN PATENT DOCUMENTS

JP 60-53164 A 3/1985
JP 10-137365 A 5/1998
JP 10-179799 A 7/1998
JP 2002-517296 A 6/2002
JP 2002-536143 A 10/2002
JP 2004-504900 A 2/2004

* cited by examiner

*Primary Examiner*—Raeann Trimiew
(74) *Attorney, Agent, or Firm*—Birch, Stewart, Kolasch & Birch, LLP.

(57) ABSTRACT

The present invention provides a golf ball comprising a core, an intermediate layer covering the core, and a cover covering the intermediate layer, wherein the intermediate layer contains a 3-dimensional shaped metal oxide having at least three needle-shaped parts. Blending the 3-dimensional shaped metal oxide into the intermediate layer enhances the rigidity of the resultant intermediate layer and the hardness thereof. Making use of this property, it is possible to improve the durability, the flight performance and the shot feeling of the golf ball.

15 Claims, 5 Drawing Sheets

GOLF BALL

BACKGROUND OF THE INVENTION

1. Field of the Invention

The present invention relates to a golf ball, more particularly to a technique which improves the intermediate layer of the golf ball.

2. Description of the Related Art

The resilience (flight distance), durability, shot feeling, control, abrasion resistance are required for golf balls, and the various fillers are added into portions constituting the golf ball body to improve the above requirements.

For example, Japanese patent publication No. S60-53,164A discloses a solid golf ball having a high residence and improved flight performance. The solid golf ball comprises a core and a cover covering the core. The core is made from polymer blends having the gravity of not more than 1.30 in the case of the small sized golf ball, or from polymer blends having the gravity of not more than 1.5 in the case of the large sized golf ball. In addition, the cover is formed to have the gravity of not less than 1.0, or a weight ball is placed in the center of the core. Japanese patent publication No. H10-137,365 discloses a golf ball comprising a cover. In the golf ball having the cover made from the cover material including a thermoplastic resin or a thermoplastic elastomer as a main component, the filamental aluminum borate whisker is formulated into the cover material. Japanese patent publication No. H10-179,799 discloses a golf ball having a core comprising a thermoplastic resin or a thermoplastic elastomer, wherein the filamental aluminum borate whisker is formulated into the core. Further, it is proposed that a nano composite filler such hydrotalcite and octosilicate is added into the resin composition in Japanese patent publication No.2,004-504,900.

Japanese patent publication No. 2,002-517,296 discloses a golf ball where a glass fiber, a carbon fiber, an aramide fiber, or a metal fiber are formulated into the intermediate layer, and Japanese patent publication No.2,002-536,143 discloses a golf ball reinforced by formulating metals or ceramic into the intermediate layer.

SUMMARY OF THE INVENTION

The major object of adding a filler in a powder shape (granular shape) into the intermediate layer is to adjust the gravity of the whole golf ball and thus the golf ball property is not improved well. On the other hand, if the filamental filler such as a filamental whisker is used for the intermediate layer, the filamental filler is oriented along a flow direction of the resin component at the injection molding of the intermediate layer, and the anisotropy will generate in the obtained intermediate layer. As a result, the durability of the golf ball is not improved well. The nano composite filler has low dispersibility into the hydrophobic resin such as an ionomer resin or polyurethane typically used for the intermediate layer and thus coagulates or unevenly dispersed. As a result, the ball property is not improved as well as expected. Incorporating metal or ceramic into the intermediate layer causes to increase the rigidity as well as the hardness of the intermediate layer. Thus, if the rigidity is excessively increased to improve the flight distance, since the hardness of the intermediate layer becomes too high, the shot feeling is deteriorated. As mentioned above, the golf balls satisfying the golfers sufficiently are not obtained by such a conventional technique as adding various fillers into each part constituting the golf ball body. Especially, the flight distance is required for the golf ball when hitting the golf ball with a driver. But the conventional method of adding the filler into the intermediate layer and enhancing the rigidity thereof to increase the flight distance also results in the higher hardness of the intermediate layer. As a result, the shot feeling is deteriorated due to the excessively high hardness of the intermediate layer.

The present invention has been achieved in view of the above circumstances and is directed to the golf ball having the improved properties. The present invention provides a golf ball comprising a core, an intermediate layer covering the core and a cover covering the intermediate layer, wherein the intermediate layer comprises a 3-dimensional shaped metal oxide having at least three needle-shaped parts. Since the metal oxide used in the present invention has 3-dimensional shape with at least three needle-shaped parts, the orientation of the metal oxide along the flow direction of the resin component at the injection molding of the intermediate layer is suppressed. As a result, the anisotropy of the resultant intermediate layer is lowered and thus the durability of the golf ball is improved.

Further, blending the 3-dimensional shaped metal oxide into the intermediate layer enhances the rigidity of the resultant intermediate layer for the hardness thereof. This property can be applied to enhance the durability, the flight performance and the shot feeling of the golf ball.

DESCRIPTION OF THE PREFERRED EMBODIMENT

The present invention provides a golf ball comprising a core, an intermediate layer covering the core and a cover covering the intermediate layer as an outermost layer, wherein the intermediate layer comprises a 3-dimensional shaped metal oxide having at least three needle-shaped parts. Hereinafter, "3-dimensional shaped metal oxide having at least three needle-shaped parts" may be referred to as just "3-dimensional shaped metal oxide."

First of all, the 3-dimensional shaped metal oxide will be explained. The metal oxide used in the present invention is not limited, as long as it has at least three needle-shaped parts in the 3-dimensional shape. For example, in a preferable embodiment, the needle-shaped parts are joined at one end thereof and the other ends extend in different directions. In a more preferable embodiment, the metal oxide has four needle-shaped parts in the 3-dimensional shape (namely, "tetrapod" shape) where the four needle-shaped parts are joined at one end thereof at about the center of a regular tetrahedron and the other ends extend towards about the corners of the regular tetrahedron, respectively. The needle-shaped part is preferably an acicular crystal of a metal oxide.

Figure 1:
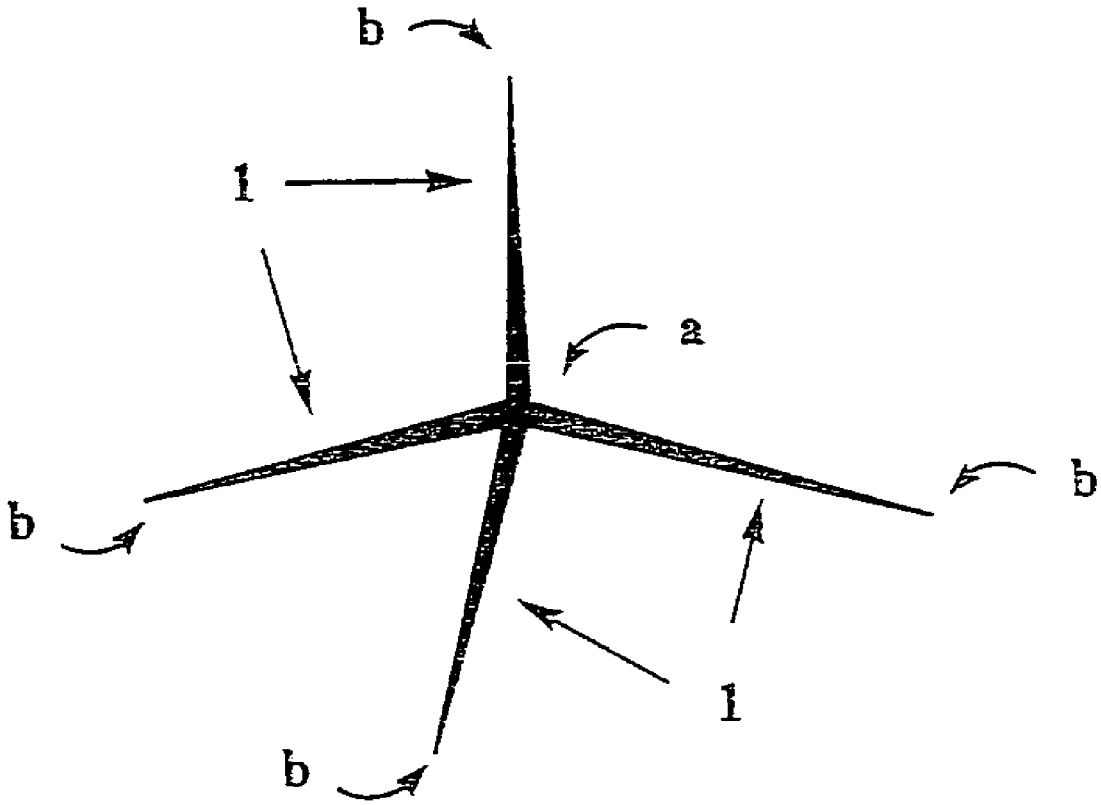
FIG. 1 illustrates an example of the 3-dimensional shaped metal oxide having at least three needle-shaped parts used in the present invention.

FIG. 1 illustrates an example of the 3-dimensional shaped metal oxide used in the present invention. Four needle-shaped parts 1 have nearly the same length, are joined at the one end a thereof at about the center of a regular tetrahedron, and the other ends b thereof extend towards about the corners of the regular tetrahedron.

The metal oxide has the needle-shaped parts with the average length of preferably 5 μm or more, more preferably 7 μm or more, and with the average length of preferably 50 μm or less, more preferably 40 μm or less. If the average length is less than 5 μm, the desired rigidity may not be obtained, while if the average length is more than 50 μm, the dispersibility of the 3-dimensional shaped metal oxide into the cover layer may be deteriorated. The needle-shaped part, without limitation, preferably has an average diameter of from 0.2 μm to 3 μm.

Examples of the metal oxide constituting the 3-dimensional shaped metal oxide include zinc oxide, titanium oxide, barium sulfate, and talc. Zinc oxide is a preferable metal oxide. Specific example of the 3-dimensional shaped metal oxide used in the present invention is "zinc oxide whisker in a tetrapod shape, commercial name of 'Pana-Tetra'" available from Matsushita Electronic Industrial Co., Ltd.

In the present invention, the intermediate layer preferably contains the 3-dimensional shaped metal oxide in an amount of 0.3 part or more, more preferably 0.5 part or more, even more preferably 5 parts or more, and in an amount of 25 parts or less, more preferably 20 parts or less, even more preferably 15 parts or less, by mass with respect to 100 parts of the base resin component. Containing the 3-dimensional shaped metal oxide in an amount of 0.3 part or more enhances the rigidity of the resultant intermediate layer. On the other hand, containing the 3-dimensional shaped metal oxide in an amount of 25 parts or less enhances the dispersibility of the 3-dimensional shaped metal oxide into the intermediate layer and thus the durability of the resultant golf ball is improved.

The present invention has no limitation on a base resin component constituting the intermediate layer. Examples of the base resin components are polyurethane, an ionomer resin, polyamide, polyester and a mixture thereof.

As the polyurethane used as the base resin component of the intermediate layer, the polyurethane has no limitation, as long as it has a plurality of urethane bonds in the molecule thereof. The polyurethane is, for example, a reaction product obtainable by reacting a polyisocyanate with a polyol, if necessary, by further reacting with a polyamine. The polyurethane includes a thermoplastic polyurethane and a thermosetting (two component curing type) polyurethane. In the present invention, the thermoplastic polyurethane is preferably used, and the thermoplastic polyurethane elastomer is more preferably used as the base resin component of the intermediate layer. The thermoplastic polyurethane elastomer used herein is the polyurethane having so-called "rubber elasticity." The use of the thermoplastic polyurethane elastomer provides the intermediate layer with the high resilience. The thermoplastic polyurethane elastomer is not limited, as long as it can be molded into the cover by injection-molding or compression molding. Examples of the thermoplastic polyurethane elastomer are "ELASTOLLAN XNY 90A", "ELASTOLLAN XNY 97A", and "ELASTOLLAN XNY585" available from BASF POLYURETHANE ELASTOMERS.

In one preferable embodiment, the ionomer resin is used as the base resin component constituting the intermediate layer. Examples of the ionomer resin are one prepared by neutralizing at least a part of carboxyl groups in a copolymer composed of ethylene and α,β-unsaturated carboxylic acid with a metal ion, one prepared by neutralizing at least a part of carboxyl groups in a terpolymer composed of ethylene, α,β-unsaturated carboxylic acid and α,β-unsaturated carboxylic acid ester with a metal ion, or a mixture them.

Examples of the α,β-unsaturated carboxylic acid are acrylic acid, methacrylic acid, fumaric acid, maleic acid, and crotonic acid. Acrylic acid and methacrylic acid are preferable. Examples of the α,β-unsaturated carboxylic acid ester are methyl ester, ethyl ester, propyl ester, n-butyl ester, isobutyl ester and the like of acrylic acid, and methacrylic acid. Especially, the ester of acrylic acid and methacrylic acid are preferable.

The metal ion for neutralizing at least a part of the carboxyl groups includes an alkali metal ion such as sodium, potassium, and lithium; a divalent metal ion such as magnesium, calcium, zinc, barium, and cadmium; a trivalent metal ion such as aluminum, or other metal ions such as tin, and zirconium. Among them, sodium, zinc, and magnesium are preferably used to improve the resilience and the durability.

Specific examples of the ionomer resin are, but not limited to, HIMILAN 1555(Na), HIMILAN 1557(Zn), HIMILAN 1605 (Na), HIMILAN 1706 (Zn), HIMILAN 1707 (Na), HIMILAN AM7311 (Mg), and examples of the terpolymer are HIMILAN 1856(Na) and HIMILAN 1855(Zn) available from MITSUI-DUPONT POLYCHEMICAL CO.

Examples of the ionomer resins available from DUPONT CO. are SURLYN 8945 (Na), SURLYN 9945 (Zn), SURLYN 8140(Na), SURLYN 8150(Na), SURLYN 9120(Zn), SURLYN 9150(Zn), SURLYN 6910(Mg), SURLYN 6120(Mg), SURLYN 7930(Li), SURLYN 7940(Li), SURLYN AD8546 (Li), and examples of the terpolymer are SURLYN 8120 (Na), SURLYN 8320(Na), SURLYN 9320(Zn), and SURLYN 6320(Mg).

Examples of the ionomer resins available from Exxon Co. are IOTEK 8000(Na), IOTEK 8030(Na), IOTEK 7010(Zn), IOTEK 7030 (Zn), and examples of the terpolymer are IOTEK 7510(Zn), and IOTEK 7520(Zn). These ionomers may be used individually or as a mixture of two or more of them. Na, Zn, K, Li, or Mg described in the parentheses after the commercial name of the ionomer resin represent a kind of metal used for neutralization.

The base resin component constituting the intermediate layer may further include a thermoplastic elastomer, a diene type block copolymer and the like in addition to the above polyurethane or the ionomer resin. Examples of the thermoplastic elastomer are a polyamide elastomer having a commercial name "PEBAX", for example "PEBAX 2533", available from ARKEMA Inc, a polyester elastomer having a commercial name of "HYTREL", for example "HYTREL 3548", "HYTREL 4047", available from DU PONT-TORAY Co, a polyurethane elastomer having a commercial name "ELASTOLLAN", for example "ELLASTOLLAN ET880" available from BASF POLYURETHANE ELASTOMERS Co, a polystyrene elastomer having a commercial name "Rabalon" available from Mitsubishi Chemical Co. Among them, the thermoplastic polystyrene elastomer is preferable. The thermoplastic polystyrene elastomer includes, for example, a polystyrene-diene block copolymer comprising a polystyrene block component as a hard segment and a diene block component, for example polybutadiene, isoprene, hydrogenated polybutadiene, hydrogenated polyisoprene, as a soft segment. The polystyrene-diene block copolymer comprises a double bond derived from a conjugated diene compound of block copolymer or hydrogenated block copolymer. Examples of the polystyrene-diene block copolymer are a block copolymer having a SBS (styrene-butadiene-styrene) structure comprising polybutadiene block; and a block copolymer having a SIS (styrene-isoprene-styrene) structure. Specific examples of the diene block copolymer are "Epo friend A1010" available from DAICEL CHEMICAL INDUTRIES, LTD., and "Septon HG-252" available from KURARAY CO.,LTD.

The intermediate layer of the present invention may further include a pigment such as titanium oxide and a blue pigment; a gravity adjusting agent such as barium sulfate and calcium carbonate; a dispersant, an antioxidant, an ultraviolet absorber, a light stabilizer, a fluorescent material, and a fluorescent brightener in addition to the above base resin component and the 3-dimensional shaped metal oxide, unless they impart any undesirable property.

In one preferable embodiment of the present invention, the intermediate layer of the present invention has the slab hardness less than 55 D, more preferably 50 D or less, even more preferably 45 D or less, and has the slab hardness of 20 D or more, more preferably 25 D or more in shore D hardness. If the intermediate layer has the slab hardness less than 55 D in shore D hardness, since the intermediate layer deforms appropriately when hitting the golf ball, and thus the flight distance increases due to the low spin rate. Further, the shot feeling also becomes good. On the other hand, if the intermediate layer has the slab hardness of 20 D or more, the resilience of the obtained golf ball becomes high and thus the flight distance increases. Herein, the slab hardness of the intermediate layer means a hardness measuring the hardness of the intermediate layer molded into the sheet (slab) shape. The details of the method to measure the slab hardness is described later. The slab hardness of the intermediate layer can be adjusted, for example, by appropriately selecting the combination of the base resin components, or the content of the 3-dimensional shaped metal oxide.

In the above preferable embodiment where the intermediate layer has the slab hardness less than 55 D, the slab hardness Xm (shore D hardness), the bending rigidity Ym (MPa) of the intermediate layer, the slab hardness Xr (shore D hardness) and the bending rigidity Yr (MPa) of the base resin component of the intermediate layer satisfy the following equations:

$$(Ym/Xm)/(Yr/Xr) \geqq 1.05 \quad (1)$$

In the present invention, blending the 3-dimensional shaped metal oxide into the intermediate layer enhances the rigidity of the resultant intermediate layer for the hardness thereof. This property indicates that the resilience of the resultant golf ball can be enhanced without lowering the shot feeling. In the case that the conventional granular metal oxide or acicula whisker are formulated into the intermediate layer and that the rigidity is enhanced to obtain the high resilience, the hardness also becomes high and thus the shot feeling of the obtained golf ball is lowered. Further, if the intermediate layer becomes too hard, since the intermediate layer does not deform appropriately when hitting the golf ball, the flight performance is lowered due to the high spin rate.

The above equation (1) indicates the relationship that the rigidity of the intermediate layer obtained by blending the filler into the intermediate layer is remarkably high for the hardness thereof, if the equation (1) is satisfied by comparing a ratio of the bending rigidity Ym (MPa) to the slab hardness Xm (shore D) of the intermediate layer with a ratio of the bending rigidity Yr (MPa) to the slab hardness Xr (shore D) of the base resin component of the intermediate layer. The equation (1) can be satisfied, for example, by appropriately selecting the combinations of the base resin components, or the contents of the 3-dimensional shaped metal oxide. Preferably, the equation (1) can be satisfied by appropriately adjusting the blending ratio of the polystyrene elastomer to the ionomer resin.

The intermediate layer of the golf ball of the present invention has no limitation on the structure, as long as it comprises at least one layer. In the case that the intermediate layer is composed of at least two layers, at least one layer of the intermediate layer may comprise the above 3-dimensional shaped metal oxide and have the slab hardness falling within the above shore D hardness range. Further, the slab hardness Xm (Shore D hardness) and the bending rigidity Ym (MPa) of the layer comprising the 3-dimensional shaped metal oxide and the slab hardness Xr (Shore D hardness) and the bending rigidity Yr (MPa) of the base resin of the layer comprising the 3-dimensional shaped metal oxide may satisfy the above equation (1). In the preferable embodiment, all of the multi-layers constituting the intermediate layer comprise the above 3-dimensional shaped metal oxide and have the slab hardness falling within the above shore D hardness range. In this case, the slab hardness Xm (Shore D hardness), the bending rigidity Ym (MPa) of all of the multi-layers comprising the 3-dimensional shaped metal oxide, the slab hardness Xr (Shore D hardness) and the bending rigidity Yr (MPa) of the base resin of each of the multi-layers comprising the 3-dimensional shaped metal oxide satisfy the above equation (1).

In the above preferable embodiment, the intermediate layer has a thickness of 1.6 mm or less, more preferably 1.2 mm or less, even more preferably 1.0 mm or less. Since the intermediate layer of the present invention is relatively soft, if the thickness is more than 1.6 mm, the resilience of the obtained golf ball is lowered. The lower limit of the thickness of the intermediate layer is for example, but is not limited to, 0.2 mm, more preferably 0.4 mm. Because it may be difficult to form the intermediate layer with the thickness of less than 0.2 mm.

In another preferable embodiment of the present invention, the intermediate layer of the present invention has the slab hardness of 55 D or more, more preferably 56 D or more, even more preferably 57 D or more, most preferably 60 D or more, and has the slab hardness of 65 D or less, more preferably 64 D or less in shore D hardness. If the slab hardness of the intermediate layer is excessively low, the resilience of the obtained golf ball may be insufficient. On the other hand, if the slab hardness of the intermediate layer is too high, the shot feeling may be lowered. Herein, the slab hardness of the intermediate layer means a hardness measuring the hardness of the intermediate layer molded into the sheet (slab) shape. The details of the method to measure the slab hardness are described later. The slab hardness of the intermediate layer can be adjusted, for example, by appropriately selecting the combination of the base resin components, or the content of the 3-dimensional shaped metal oxide.

In the above preferable embodiment where the intermediate layer has the slab hardness of 55 D or more, the slab hardness X (shore D hardness) and the bending rigidity Y (MPa) of the intermediate layer satisfies the following equations:

$$55 \leqq X \leqq 65 \quad (2)$$

$$Y \geqq 18X - 850 \text{ (preferably } Y \geqq 18X - 847) \quad (3)$$

In the present invention, blending the 3-dimensional shaped metal oxide into the intermediate layer enhances the rigidity of the resultant intermediate layer for the hardness thereof. This property indicates that the resilience can be enhanced without lowering the shot feeling. In the case that the conventional granular metal oxide or acicula whisker are formulated into the intermediate layer and that the rigidity is enhanced to obtain the high resilience, the hardness also becomes high and thus the shot feeling of the obtained golf ball is lowered.

The above equations (2) and (3) indicate the relationship that even if the slab hardness X (shore D) of the intermediate layer falls within the range from 55 to 65 to provide the good shot feeling, the bending rigidity Y becomes high enough to satisfy the equation (3). The equation (3) can be satisfied, for example, by appropriately selecting the combinations of the base resin components, or the contents of the 3-dimensional shaped metal oxide. Preferably, the equation (3) can be satisfied by appropriately adjusting the blending ratio of the polystyrene elastomer to the ionomer resin.

The intermediate layer of the golf ball of the present invention has no limitation on the structure, as long as it comprises at least one layer. In the case that the intermediate layer is composed of at least two layers, at least one layer of the intermediate layer may comprise the above 3-dimensional shaped metal oxide and have the slab hardness falling within the above shore D hardness range. Further, the slab hardness X (Shore D hardness) and the bending rigidity Y (MPa) of the layer comprising the 3-dimensional shaped metal oxide may satisfy the above equation (3). In the preferable embodiment, all of the multi-layers constituting the intermediate layer comprise the above 3-dimensional shaped metal oxide and have the slab hardness falling within the above shore D hardness range (equation (2)). In this case, the slab hardness X (Shore D hardness) and the bending rigidity Y (MPa) of each of the multi-layers comprising the 3-dimensional shaped metal oxide satisfy the above equation (3).

In the above preferable embodiment, the intermediate layer has a thickness of 1.4 mm or less, more preferably 1.2 mm or less, even more preferably 1.0 mm or less. If the thickness is too thick, the flight distance becomes low due to the insufficient launch angle of the golf ball. The lower limit of the thickness of the intermediate layer is for example, but is not limited to, 0.6 mm, more preferably 0.7 mm, even more preferably 0.8 mm. If the thickness of the intermediate layer is too thin, the resilience is lowered.

In a process of preparing the golf ball of the present invention, the intermediate layer is formed, for example, by covering the core described above with the intermediate layer composition and molding into the intermediate layer. Examples of the method of molding the intermediate layer are, without limitation, a method including previously molding the intermediate layer composition into two hemispherical half shells, covering the core together with the two half shells, and subjecting the core with two half shells to the pressure molding at 130 to 170° C. for 1 to 5 minutes, or a method including injection-molding the intermediate layer composition directly onto the core to form an intermediate layer.

In the present invention, the core is basically formed by heat-pressing a rubber composition for the core that comprises the base rubber, a crosslinking initiator, a co-crosslinking agent, a filler, and an antioxidant. The core has no limitation as long as it contains at least one layer and may have either a single-layered structure or a multi-layered structure of at least two layers. The base rubber preferably includes a natural rubber and/or a synthetic rubber. Examples of the base rubber are butadiene rubber (BR), ethylene-propylene-diene terpolymer (EPDM), isoprene rubber (IR), styrene-butadiene rubber (SBR), and acrylonitrile-butadiene rubber (NBR). Among them, in view of its superior repulsion property, typically preferred is the high cis-polybutadiene rubber having cis-1,4 bond in a proportion of not less than 40%, more preferably not less than 70%, even more preferably not less than 90%.

As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. The amount of the organic peroxide to be blended in the rubber composition is preferably not less than 0.3 part by mass, more preferably not less than 0.4 part by mass, and preferably not more than 5 parts by mass, more preferably not more than 3 parts by mass based on 100 parts by mass of the base rubber. If the content is less than 0.3 part by mass, the core becomes too soft, and the resilience tends to be lowered, and if the content is more than 5 parts by mass, the core becomes too hard and the shot feeling may be lowered.

The co-crosslinking agent used in the present invention includes, for example, an α,β-unsaturated carboxylic acid having 3 to 8 carbon atoms or a metal salt thereof. As the metal forming the metal salt of the α,β-unsaturated carboxylic acid, a monovalent or divalent metal such as zinc, magnesium, calcium, aluminum and sodium is preferably used. Among them, zinc is preferable, because it can impart the higher repulsion property to the golfball. Specific examples of the α,β-unsaturated carboxylic acid or a metal salt thereof are acrylic acid, methacrylic acid, zinc acrylate, and zinc methacrylate.

In the case that the core has a two-layered structure comprising an inner core and an outer core and the thickness of the outer core is made thin, the zinc salt of α,β-unsaturated carboxylic acid providing the high resilience, especially zinc acrylate is preferable for the inner core layer and the magnesium salt of α,β-unsaturated carboxylic acid providing the good mold-releasing property, especially magnesium methacrylate is preferable for the outer core layer.

The amount of the co-crosslinking agent to be blended in the rubber composition is preferably not less than 10 parts by mass, more preferably not less than 15 parts by mass, even more preferably not less than 20 parts by mass, and preferably not more than 55 parts by mass, more preferably not more than 50 parts by mass, even more preferably not more than 48 parts by mass based on 100 parts by mass of the base rubber. If the content of the co-crosslinking agent is less than 10 parts by mass, the amount of the organic peroxide must be increased to provide the appropriate hardness, and thus the resilience tends to be lowered. On the other hand, if the content of the co-crosslinking agent is more than 55 parts by mass, the core becomes too hard and thus the shot feeling may be lowered.

As the filler, a filler conventionally formulated in the core of the golf ball can be used. The filler includes, for example, an inorganic salt such as zinc oxide, barium sulfate and calcium carbonate, a high gravity metal powder such as tungsten powder, and molybdenum powder and the mixture thereof. The content of the filler is preferably not less than 0.5 part by mass, more preferably not less than 1 part by mass, and is preferably not more than 30 parts by mass, more preferably not more than 20 parts by mass. If the content is less than 0.5 part by mass, it would be difficult to adjust the gravity, while if the content is more than 30 parts by mass, the ratio of the rubber contained in the whole core becomes low and thus the resilience is lowered.

The rubber composition for the core may further include an organic sulfur compound, an antioxidant, or a peptizing agent, as required in addition to the base rubber, the co-crosslinking agent, the crosslinking initiator and the filler.

Examples of the organic sulfur compound are diphenyl disulfide; mono-substituted diphenyl disulfide such as bis(4-chlorophenyl) disulfide, bis(3-chlorophenyl) disulfide, bis(4-bromophenyl) disulfide, bis(3-bromophenyl) disulfide, bis(4-fluorophenyl) disulfide, bis(4-iodophenyl) disulfide, and bis(4-cyanophenyl) disulfide; di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis(3,5-dibromophenyl) disulfide, bis(2-chloro-5-bromophenyl) disulfide, and bis(2-cyano-5-bromophenyl) disulfide; tri-substituted diphenyl disulfides such as bis(2,4,6-trichlorophenyl) disulfide and bis(2-cyano-4-chloro-6-bromophenyl) disulfide; tetra-substituted diphenyl disulfide such as bis(2,3,5,6-tetrachlorophenyl) disulfide; and penta-substituted diphenyl disulfide such as bis(2,3,4,5,6-pentachlorophenyl) disulfide and bis(2,3,4,5,6-pentabromophenyl) disulfide. These diphenyl disulfide derivatives have some sort of effect on the crosslinking state of the vulcanized rubber and thus enhance the resilience. Among them, diphenyl disulfide and bis(pentabromophenyl) disulfide are particularly preferable, because the golf ball having the very high resilience is obtained.

The amount of the antioxidant is not less than 0.1 part and not more than 1 part with respect to 100 parts of the base rubber by mass. The amount of the peptizing agent is not less than 0.1 part and not more than 5 parts with respect to 100 parts of the base rubber by mass.

The core is formed by kneading the above rubber composition and press-molding it into the spherical body in the mold. The conditions for the press-molding should be determined depending on the rubber composition. The press-molding is preferably carried out for 10 to 40 minutes at the temperature of 130 to 180° C. under the pressure of 2.9 MPa to 11.8 MPa.

The core preferably has a diameter of 30 mm or more, more preferably 32 mm or more, and preferably has a diameter of 41 mm or less, more preferably 40.5 mm or less. If the diameter of the core is less than 30 mm, the thickness of the intermediate layer and the cover becomes thicker than the desired thickness and thus the resilience may be lowered. On the other hand, if the diameter of the core is larger than 41 mm, the thickness of the intermediate layer and the cover becomes thinner than the desired thickness and thus the intermediate layer or the cover may not function well.

In the case that the core has a diameter of 30 mm to 41 mm, the core preferably has a compression deformation amount (an amount which shrinks along the direction of the compression) of 2.5 mm or more, more preferably 3.0 mm or more and preferably has a compression deformation amount of 5.0 mm or less, more preferably 4.5 mm or less when applying a load from 98 N as an initial load to 1275 N as a final load. If the compression deformation amount is less than 2.5 mm, the shot feeling may become bad due to the hardness, while if the compression deformation amount is larger than 5.0 mm, the resilience may become low.

In one preferable embodiment, the core has the difference in the hardness between the center and the surface thereof. The difference in JIS-C hardness between the central hardness and the surface hardness is preferably at least 10, more preferably at least 12, and is preferably not more than 40, more preferably not more than 35, even more preferably not more than 30. If the difference in hardness is more than 40, the durability will be lowered, while if the difference in hardness is less than 10, the shot feeling becomes hard and thus the impact is getting large. The core preferably has the surface hardness of at least 65, more preferably at least 70, even more preferably at least 72 in JIS-C hardness, and preferably has the surface hardness of not more than 85 at the surface portion thereof. If the core has the surface hardness of less than 65 in JIS-C hardness, the core becomes too soft and the resilience is lowered. As a result, the flight distance becomes low. On the other hand, if the core has the surface hardness of more than 85, since the core is too hard, the shot feeling becomes bad. The core preferably has the central hardness of at least 45, more preferably at least 50, and preferably has the central hardness of 70 or less, more preferably 65 or less in JIS-C hardness at the central portion thereof. If the core has the central hardness less than 45, the core becomes too soft and thus the durability is lowered. If the core has the central hardness of more than 70, since the core is too hard, the shot feeling becomes bad. The difference in hardness is provided by appropriately selecting the heat-molding condition of the core.

In the present invention, the cover of the golf ball covers the intermediate layer and constitutes an outermost layer. Since the cover constitutes the outermost layer, the cover is a single-layer. The intermediate layer is a layer situated between the core and the cover constituting the outermost layer.

As a material constituting the cover of the inventive golf ball, the same materials described as the base resin component contained in the intermediate layer can be used. Examples of the material for the cover are a thermoplastic resin such as polyurethane, an ionomer resin, Nylon, and polyethylene; a thermoplastic elastomer such as a polystyrene elastomer, a polyolefin elastomer, a polyurethane elastomer, a polyester elastomer; and a diene block copolymer. The cover may further include a pigment such as titanium oxide and a blue pigment; a gravity adjusting agent such as barium sulfate and calcium carbonate; a dispersant, an antioxidant, an ultraviolet absorber, a light stabilizer, a fluorescent material, and a fluorescent brightener, unless they impart any undesirable property.

In the case that the intermediate layer has the slab hardness less than 55 D in shore D hardness, the cover has a thickness of 2.3 mm or less, more preferably 1.9 mm or less. If the thickness is more than 2.3 mm, since the cover is too thick, the resilience of the resultant golf ball is lowered at last. The lower limit of the thickness of the cover is preferably for example, but is not limited to, 0.1 mm, more preferably 0.5 mm. Because it is difficult to form the cover layer with the thickness of less than 0.1 mm.

The cover of the above embodiment preferably has the slab hardness of 57 D or more, more preferably 59 D or more, and has the slab hardness of 70 D or less, more preferably 65 D or less in shore D hardness. Since the intermediate layer used in the present invention is relatively soft (less than 55 D), if the cover has the hardness less than 57 D, the resilience of the resultant golf ball is lowered, resulting in lowering the flight distance. On the other hand, if the cover has the hardness of more than 70 D, the durability of the resultant golf ball is lowered.

The golf ball of the above embodiment, having a diameter of 42.60 mm to 42.90 mm, preferably has a compression deformation amount (an amount which shrinks along the direction of the compression) of 2.0 mm or more, more preferably 2.4 mm or more, even more preferably 2.6 mm or more, and preferably has a compression deformation amount of 4.5 mm or less, more preferably 4.0 mm or less, even more preferably 3.8 mm or less when applying a load from 98 N as an initial load to 1275 N as a final load. If the compression deformation amount is less than 2.0 mm, the shot feeling may become bad due to the hardness, while if the compression deformation amount is larger than 4.5 mm, the resilience may become low in some cases.

In the case that the intermediate layer has the slab hardness of 55 D or more in shore D hardness, the cover has a thickness of 1.6 mm or less, more preferably 1.5 mm or less, even more preferably 1.4 mm or less. If the cover is too thick, the flight distance decreases due to the insufficient launch angle. The lower limit of the thickness of the cover is preferably for example, but is not limited to, 0.3 mm, more preferably 0.5 mm. Because it is difficult to form the cover layer with the thickness of less than 0.3 mm.

The cover of the above embodiment (the intermediate layer has the slab hardness of 55 D or more) preferably has the slab hardness of 45 D or more, more preferably 48 D or more, and has the slab hardness of 64 D or less, more preferably 59 D or less in shore D hardness. If the cover has the hardness less than 45 D, the resilience of the resultant golf ball is lowered. On the other hand, if the cover has the hardness of more than 64 D, the durability of the resultant golf ball is lowered.

The golf ball of the above embodiment (the intermediate layer has the slab hardness of 55 D or more) having a diameter of 42.60 mm to 42.90 mm, preferably has a compression deformation amount (an amount which shrinks along the direction of the compression) of 2.2 mm or more, more preferably 2.3 mm or more, even more preferably 2.4 mm or more, and preferably has a compression deformation amount of 4.0 mm or less, more preferably 3.8 mm or less, even more preferably 3.6 mm or less when applying a load from 98 N as an initial load to 1275 N as a final load. If the compression deformation amount is less than 2.2 mm, the shot feeling may become bad due to the hardness, while if the compression deformation amount is larger than 4.0 mm, the resilience may become low in some cases.

In a process of preparing the golf ball of the present invention, the cover is formed, for example, by covering the intermediate layer covering the core with the cover composition and molding into the cover. Examples of the method of molding the cover are, without limitation, a method including previously molding the cover composition into two hemispherical half shells, covering the intermediate layer covering the core together with the two half shells, and subjecting the core with two half shells to the pressure molding at 130 to 170° C. for 1 to 5 minutes, or a method including injection-molding the cover composition directly onto the intermediate layer to form a cover.

Further, when forming the cover, the cover can be formed with a multiplicity of concavities, which is so called "dimple", at the surface thereof. As required, the surface of the golf ball can be subjected to grinding treatment such as sandblast in order to improve the adhesion of the mark, or the paint film.

The golf ball of the above embodiment has no limitation on the structure of the golf ball, as long as it comprises a core layer, an intermediate layer covering the core layer, and a cover covering the intermediate layer as an outermost layer. The present invention can be applied to any golf ball having the intermediate layer.

Examples of the golf ball structure are a three-piece golf ball comprising a core, an intermediate layer covering the core, and a cover covering the intermediate layer as an outermost layer and a multi-piece golf ball comprising at least four layers. Examples of the multi-piece golf ball includes a golf ball comprising a multi-layered core, an intermediate layer covering the multi-layered core and a cover as an outermost layer; a golf ball comprising a single-layered core, a multi-layered intermediate layer covering the core, and a cover as an outermost layer; and a golf ball comprising a multi-layered core, a multi-layered intermediate layer covering the multi-layered core, and a cover covering the multi-layered intermediate layer Among them, the present invention can be preferably applied to the three-piece golf ball comprising the single-layered core, the intermediate layer covering the single-layered core, and the cover covering the intermediate layer as an outermost layer.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Slab Hardness (Shore D Hardness)

The intermediate layer compositions and the cover compositions were each formed into sheets each having a thickness of about 2 mm by hot press molding and the resulting sheets were maintained at 23° C. for two weeks. Three or more of the sheets were stacked on one another to avoid being affected by the measuring substrate on which the sheets were placed, and the stack was subjected to the measurement using P1 type auto hardness tester provided with the Shore D type spring hardness tester prescribed by ASTM-D2240, available from KOUBUNSHI KEIKI CO.,LTD. For measuring the slab hardness of the base resin component of the intermediate layer, only the base resin component was used to form a sheet.

(2) Bending Rigidity (MPa)

The intermediate layer compositions were each formed into sheets each having a thickness of about 2 mm by hot press molding and the resulting sheets were maintained at 23° C. for two weeks. The bending rigidity of the sheet was determined according to JIS-K7106. For measuring the slab hardness of the base resin component of the intermediate layer, only the base resin component was used to form a sheet.

(3) Compression Deformation Amount (mm)

The compression deformation amount (amount which shrinks along the compression direction: mm) of the golf balls or the cores was measured when applying a load from 98 N(10 kgf) as an initial load to 1275 N (130 kgf) as a final load to the golf balls or the cores.

(4) Hardness of the Core

Measurement was performed using a JIS-C type spring hardness tester prescribed by JIS-K 6301. The surface hardness of the core was determined by measuring the JIS-C hardness at the surface portion of the spherical core. The central hardness of the core was determined by cutting the spherical core into two halves and measuring the JIS-C hardness at the center of the cut surface.

(5) Durability

Each golf ball was repeatedly hit with a metal head driver (W#1) attached to a swing robot manufactured by TRUETEMPER CO, at the head speed of 45 m/sec to make the golf ball collide with a collision board. Times up to which the golf balls are cracked were measured.

(6) Flight Distance(m)

Golf balls No. 1 to No. 24 were hit with a metal head driver (XXIO S 10°) attached to a swing robot manufactured by TRUETEMPER CO, at the head speed of 45 m/sec. The flight distance from the hitting point to the point where the golf ball stopped was measured. The measurement was carried out 10 times for each golf ball and the average of 10 times was regarded as the flight distance of the golf ball.

(7) Shot Feeling

Actual hitting test was carried out by 2 professional golfers and 8 high-level amateur golfers (handicap of less than 5) with the driver. The shot feeling was evaluated by the number of the golfers who made an evaluation that the impact is small and the shot feeling is good at the shot, and that the golf ball has resilience.

E (Excellent): 8 golfers or more
G (Good): 6 to 7 golfers
F (Fair): 4 to 5 golfers
P (Poor): 3 golfers or less

[Production of the Two-Piece Golf Ball]

(1) Preparation of Solid Core.

The rubber composition shown in Table 1 was kneaded and pressed in upper and lower molds each having a spherical cavity at the heating condition of 170° C. for 20 minutes to obtain the solid core in a spherical shape having a diameter of 37.0 mm to 39.0 mm.

TABLE 1

| | Core formulation | | | |
|---|---|---|---|---|
| | Core 1 | Core 2 | Core 3 | Core 4 |
| Polybutadiene rubber | 100 | 100 | 100 | 100 |
| Zinc acrylate | 22 | 24 | 21 | 24 |
| Zinc oxide | 10 | 10 | 10 | 10 |
| Barium Sulfate | *) | *) | *) | *) |
| Diphenyl disulfide | 0.5 | 0.5 | 0.5 | 0.5 |

TABLE 1-continued

| | Core formulation | | | |
|---|---|---|---|---|
| | Core 1 | Core 2 | Core 3 | Core 4 |
| Dicumyl peroxide | 0.8 | 0.8 | 0.8 | 0.7 |
| Diameter (mm) | 38.0 | 39.0 | 37.0 | 38.2 |
| Compression Deformation Amount (mm) | 4.80 | 4.30 | 5.00 | 4.30 |
| Central hardness (JIS-C) | 58 | 60 | 57 | 60 |
| Surface Hardness (JIS-C) | 74 | 76 | 73 | 78 |

Note on Table 1:
Polybutadiene rubber: BR730 (cis content: 96%) available from JSR Co.
Zinc acrylate: "ZNDA-90S" produced by NIHON JYORYU KOGYO Co., LTD.
Diphenyl disulfide: Sumitomo Seika Chemicals Company Limited
Zinc oxide: "Ginrei R" produced by Toho-Zinc Co.
Dicumyl peroxide: "Percumyl D" produced by NOF Corporation.
Barium sulfate: Barium sulfate BD available from Sakai Chemical Industry Co., LTD. The amount of barium sulfate was appropriately adjusted to obtain the golf ball having a mass of 45.4 g.

(2) Preparation of the Intermediate Layer Composition and the Cover Composition

The materials shown in Table 2 to Table 4 were mixed using a twin-screw kneading extruder to obtain the intermediate layer composition and the cover composition in the form of pellet, respectively. The extrusion was conducted in the following conditions:

screw diameter=45 mm,
screw revolutions=200 rpm,
screw L/D=35, and the mixed composition was heated to from 160° C. to 230° C. at the die position of the extruder. The slab hard ness and the bending rigidity were also shown in Table 2 and Table 3.

TABLE 2

| Intermediate layer composition | A | B | C | D | E | F | G | H |
|---|---|---|---|---|---|---|---|---|
| Formulation | — | — | — | — | — | — | — | — |
| SURLYN 8945 | 45 | 45 | 45 | 45 | 45 | 45 | 45 | 45 |
| SURLYN 9945 | 45 | 45 | 45 | 45 | 45 | 45 | 45 | 45 |
| RABALON SR04 | 10 | 10 | 10 | 10 | 10 | 10 | 10 | 10 |
| PANA TETRA WZ0501 | 0.3 | 0.5 | 5 | 20 | 25 | — | — | — |
| WHITESEAL | — | — | — | — | — | — | 5 | — |
| SURFACE STRAND REV8 | — | — | — | — | — | — | — | 5 |
| Property | — | — | — | — | — | — | — | — |
| Slab hardness (Shore D): X | 60 | 60 | 60 | 61 | 61 | 60 | 60 | 62 |
| Bending rigidity (MPa): Y | 235 | 237 | 239 | 255 | 260 | 225 | 232 | 248 |
| 18X-850 | 230 | 230 | 230 | 248 | 248 | 230 | 230 | 266 |
| 18X-847 | 233 | 233 | 233 | 251 | 251 | 233 | 233 | 269 |

Formulation: parts by mass

Notes on Table 2:

SURLYN 8945: an ionomer resin of a sodium ion-neutralized ethylene-methacrylic acid copolymer, available from DUPONT CO.

SURLYN 9945: an ionomer resin of a zinc ion-neutralized ethylene-methacrylic acid copolymer, available from DUPONT CO.

Rabalon SR04: a polystyrene elastomer available from Mitsubishi Chemical Co.

Pana Tetra WZ-0501: 3-dimensional shaped metal oxide (zinc oxide) available from Matsushita Electronic Industrial Co., Ltd.

WHITESEAL: commercially produced zinc oxide (glandular shape: particle size 344 μm) available from PT. INDO LYSAGHT Surface strandREV8: glass fiber available from NSG Vetrotex K.K.

TABLE 3

| Intermediate layer composition | I | J | K | L | M | N | O | P | Q | R | S | T | U | V | W |
|---|---|---|---|---|---|---|---|---|---|---|---|---|---|---|---|
| Formulation | — | — | — | — | — | — | — | — | — | — | — | — | — | — | — |
| HIMILAN 1605 | 30 | 35 | 30 | 30 | 30 | 30 | 30 | 35 | 50 | 50 | 30 | 30 | 30 | 30 | 30 |
| HIMILAN 1706 | 25 | 30 | 25 | 25 | 25 | 25 | 25 | 30 | 40 | 40 | 25 | 25 | 25 | 25 | 25 |
| RABALON T3339C | 45 | 35 | 45 | 45 | 45 | 45 | 45 | 35 | 10 | 10 | 45 | 45 | 45 | 45 | 45 |
| PANA TETRA WZ-0501 | 5 | 5 | 0.3 | 0.5 | 20 | 25 | — | — | — | 5 | — | — | — | — | — |
| WHITESEAL | — | — | — | — | — | — | — | — | — | — | 5 | — | — | — | — |
| ALBOREX YS3A | — | — | — | — | — | — | — | — | — | — | — | 5 | — | — | — |
| TISMO D-102 | — | — | — | — | — | — | — | — | — | — | — | — | 5 | — | — |
| SURFACE STRAND REV8 | — | — | — | — | — | — | — | — | — | — | — | — | — | 5 | — |
| M1030DH | — | — | — | — | — | — | — | — | — | — | — | — | — | — | 5 |
| Property | — | — | — | — | — | — | — | — | — | — | — | — | — | — | — |
| Slab hardness (Shore D): Xm | 40 | 48 | 40 | 40 | 40 | 41 | 40 | 48 | 59 | 59 | 42 | 42 | 42 | 42 | 42 |
| Bending rigidity (MPa): Ym | 54 | 75 | 52.5 | 53 | 55 | 57 | 50 | 70 | 200 | 210 | 52.5 | 54.5 | 53 | 54 | 54 |
| Slab hardness(Shore D): Xr | 40 | 48 | 40 | 40 | 40 | 40 | — | — | — | 59 | 40 | 40 | 40 | 40 | 40 |
| Bending rigidity (MPa): Yr | 50 | 70 | 50 | 50 | 50 | 50 | — | — | — | 200 | 50 | 50 | 50 | 50 | 50 |
| (Ym/Xm)/(Yr/Xr) | 1.08 | 1.07 | 1.05 | 1.06 | 1.10 | 1.11 | — | — | — | 1.05 | 1.00 | 1.04 | 1.01 | 1.03 | 1.03 |

Formulation: parts by mass

Notes on table 3:

HIMILAN 1605: an ionomer resin of a sodium ion-neutralized ethylene-methacrylic acid copolymer, available from MITSUI-DUPONT POLY-CHEMICAL CO., LTD.

HIMILAN 1706: an ionomer resin of a zinc ion-neutralized ethylene-methacrylic acid copolymer, available from MITSUI-DUPONT POLY-CHEMICAL CO., LTD.

ELASTOLLAN XNY97A: a H12MDI-PTMG type thermoplastic polyurethane elastomer available from BASF Japan.

Rabalon T3339C: a polystyrene elastomer available from Mitsubishi Chemical Co.

PEBAX 5533SN00: a polyamide elastomer available from ARKEMA Inc.

Pana Tetra WZ-0501: 3-dimensional shaped metal oxide (zinc oxide) available from Matsushita electronic Industrial Co., Ltd.

WHITESEAL: commercially produced zinc oxide (granular shape: particle size 344 μm) available from PT. INDO LYSAGHT ALBOREX YS3A: filamental aluminum borate whisker available from Shikoku Chemicals Corp.

TISMO D-102: needle shaped potassium titanate fiber available from Otsuka Chemical Co., Ltd.

Surface strandREV8: glass fiber available from NSG Vetrotex K.K.

M1030DH: nano composite available from Unitika LTD. (Layered silicate salt are very finely dispersed into Nylon 6)

TABLE 4

| Cover composition | A | B | C |
|---|---|---|---|
| SURLYN 8945 | 38 | — | — |
| SURLYN 9945 | 38 | — | — |
| RABALON SR04 | 24 | — | — |
| ELASTOLLAN XNY97A | — | 100 | — |
| HIMILAN 1555 | — | — | 50 |
| HIMILAN 1557 | — | — | 50 |
| Titanium dioxide | 3 | 3 | 3 |
| Ultramarine blue | 0.1 | 0.1 | 0.1 |
| Slab hardness (Shore D) | 54 | 47 | 59 |

Formulation: parts by mass (3) Preparation of the Golf Ball Body

The intermediate layer composition thus prepared was directly injection-molded onto the core to form the intermediate layer and then the cover composition was directly injection-molded onto the intermediate layer to form the cover covering the intermediate layer.

The upper and lower molds for forming the cover have a spherical cavity with dimples. The part of the dimples can serve as a hold pin which is retractable. When forming the golf ball body, the hold pins were protruded to hold the core, and the composition heated at 210° C. was charged into the mold held under the pressure of 80 tons for 0.3 second. After the cooling for 30 seconds, the molds were opened and then the golf ball body was discharged. The surface of the obtained golf ball was subjected to the sand-blast treatment, and then the mark was printed and the clear paint was coated on the surface of the golf ball respectively. The paint was dried in an oven kept at 40° C. to obtain the golf ball having a diameter of 42.7 mm and a mass of 45.4 g. The golf balls were formed with a dimple pattern shown in Table 5 and FIGS. 2 to 4 at the surface thereof.

TABLE 5

Figure 2:
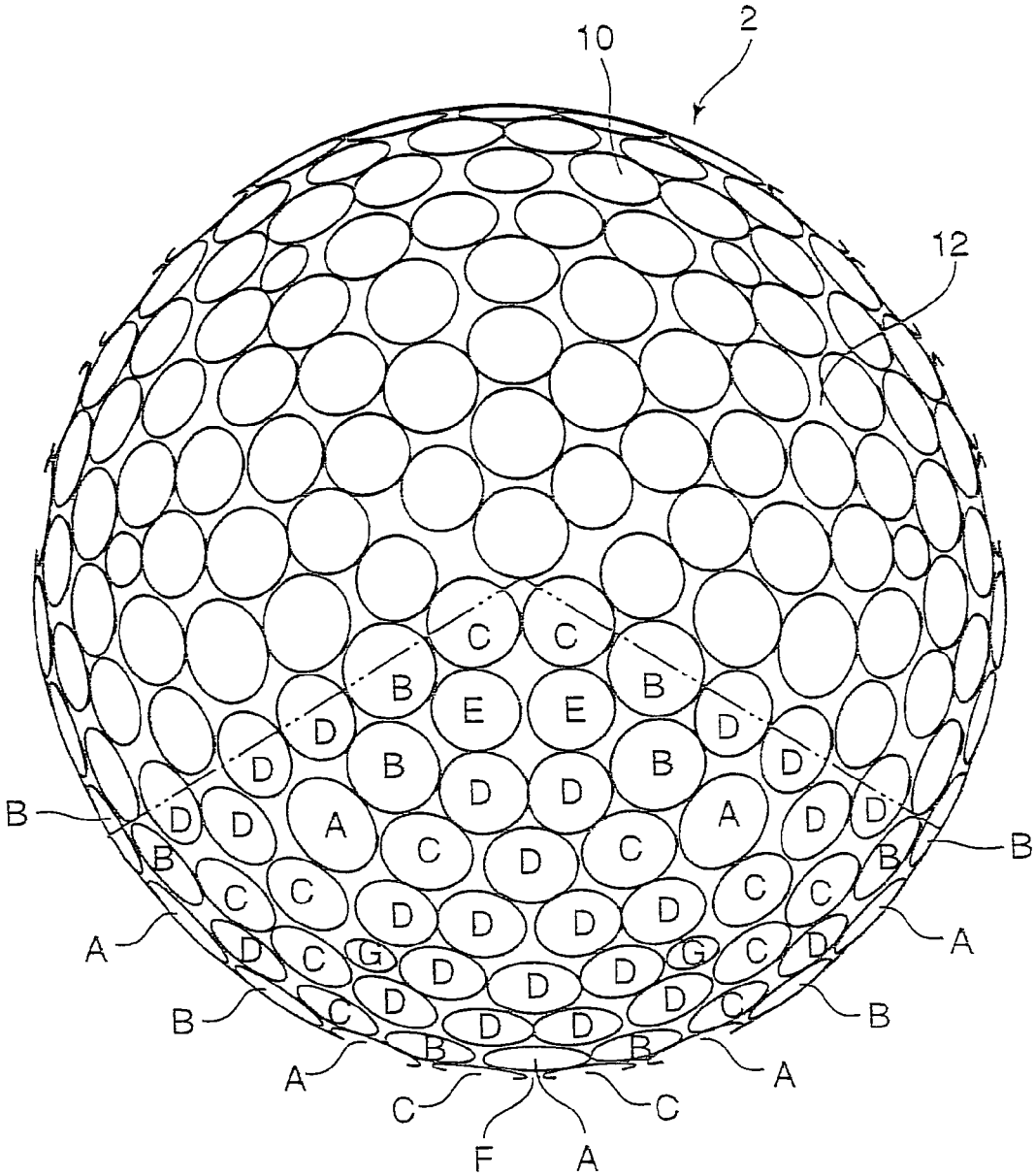
FIG. 2 is a plan view of the golf ball formed with dimples at the surface thereof.
Figure 3:
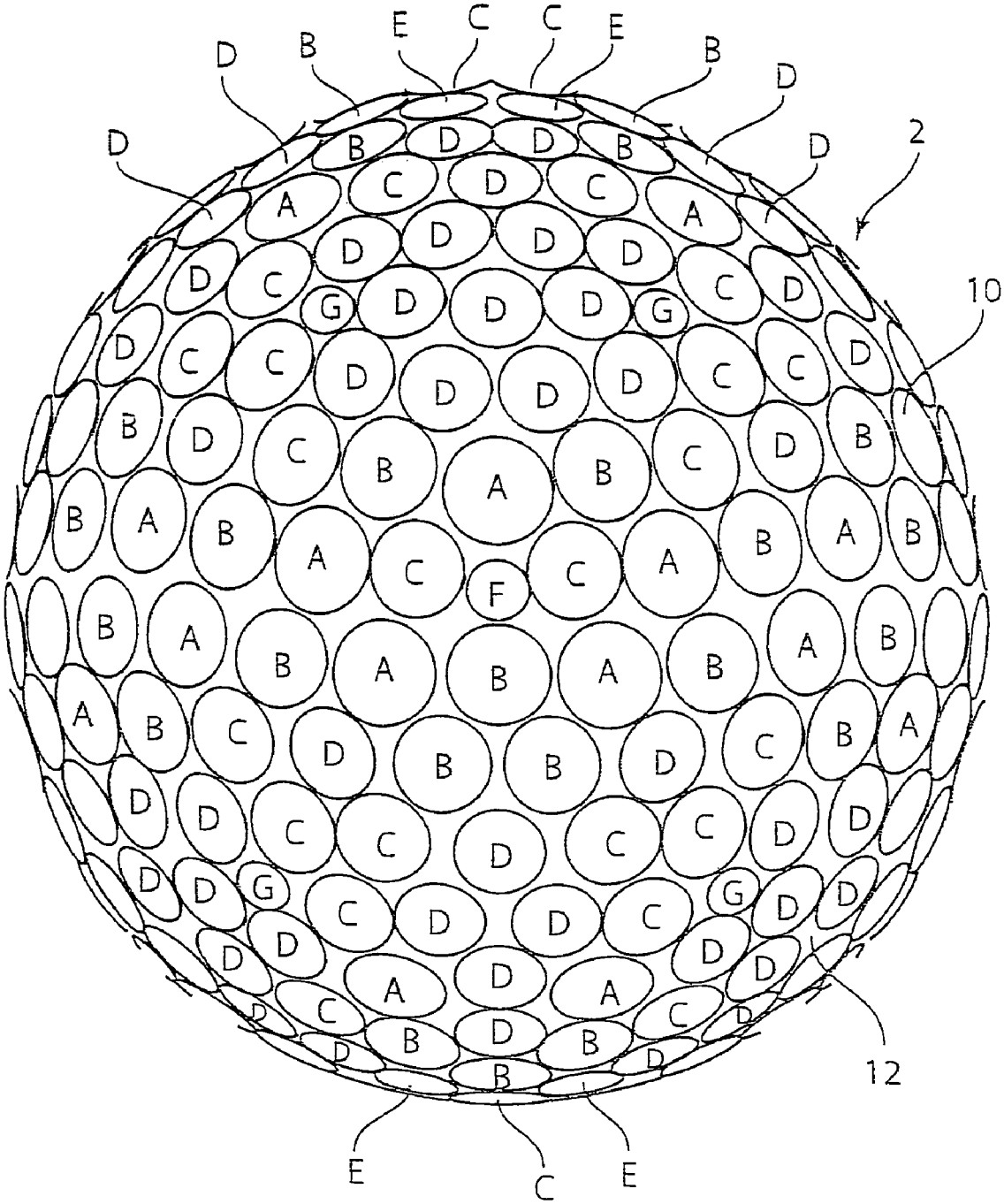
FIG. 3 is a front view of the golf ball formed with dimples at the surface thereof.
Figure 4:
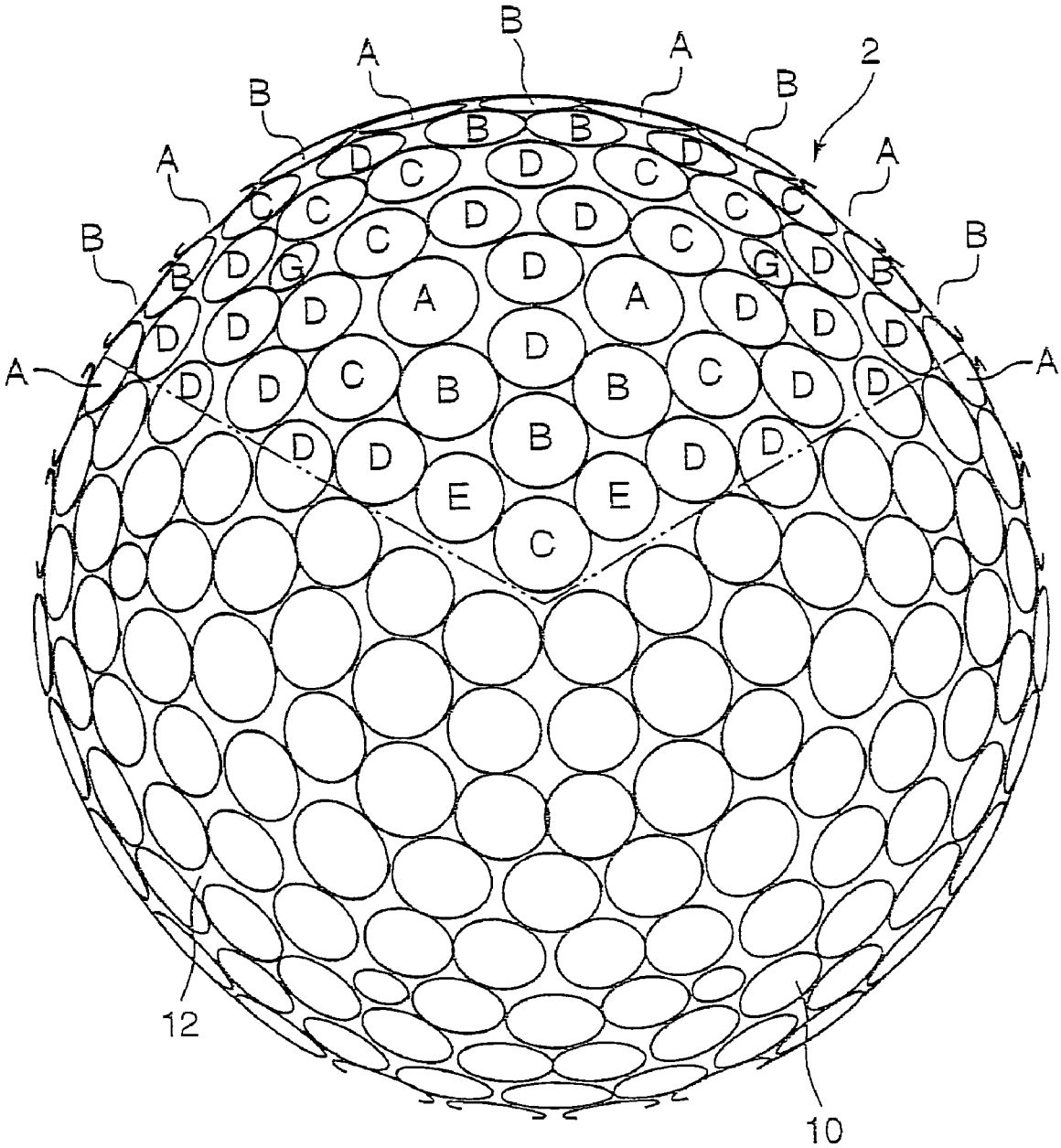
FIG. 4 is a bottom view of the golf ball formed with dimples at the surface thereof.

| Type | Number | Diameter (mm) | Depth (mm) | Volume ($mm^3$) | Plan view | Front view | Bottom view |
|---|---|---|---|---|---|---|---|
| A | 42 | 4.65 | 0.135 | 1.148 | FIG. 2 | FIG. 3 | FIG. 4 |
| B | 66 | 4.45 | 0.134 | 1.043 | | | |
| C | 72 | 4.25 | 0.134 | 0.952 | | | |
| D | 126 | 4.05 | 0.134 | 0.864 | | | |
| E | 12 | 3.95 | 0.133 | 0.816 | | | |
| F | 3 | 2.80 | 0.132 | 0.408 | | | |
| G | 12 | 2.65 | 0.132 | 0.365 | | | |

Figure 5:
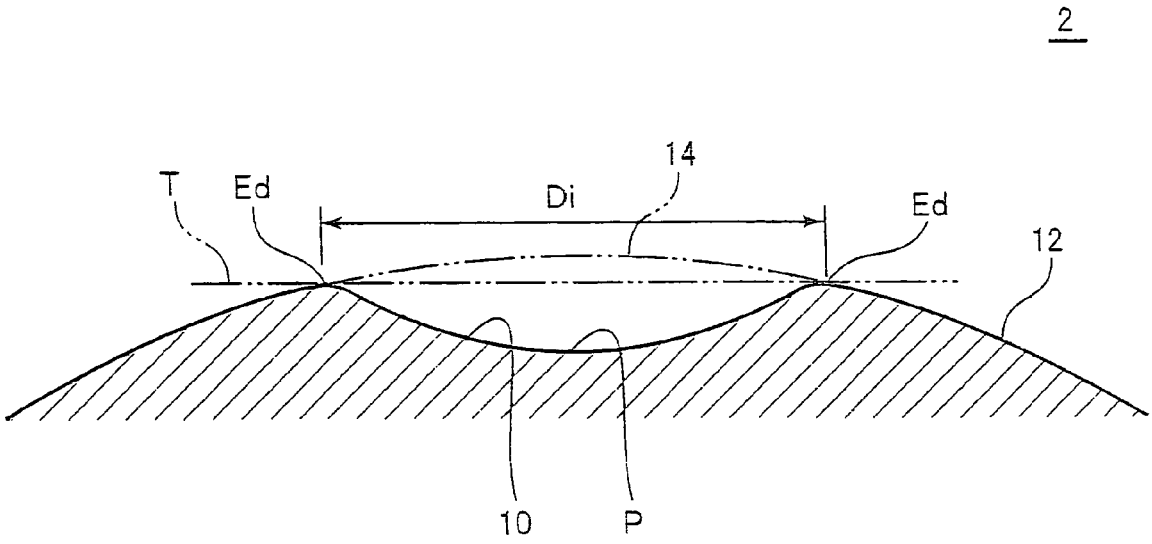
FIG. 5 is an enlarged sectional view of a dimple formed at the surface of the golf ball.

In table 5, "Diameter" of the dimple corresponds to Di, "Depth" represents the distance between the tangential line T and the deepest portion P, and "volume" means the volume enclosed with the plane comprising the outline of dimple 10 and the hypothetical ball 14 in FIG. 5.

The obtained golf balls were evaluated in terms of durability, flight distance, and shot feeling. The results were also shown in table 6 and table 7 in addition to the structure of the golf ball.

TABLE 6

| | Golf ball No. | | | | | | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Structure | — | — | — | — | — | — | — | — | — | — | — |
| Type of core | 1 | 1 | 1 | 1 | 1 | 2 | 3 | 2 | 1 | 1 | 1 |
| Type of Intermediate layer | C | A | B | D | E | C | C | C | F | G | H |
| Slab hardness (shore D) of Intermediate layer | 60 | 60 | 60 | 61 | 61 | 60 | 60 | 60 | 60 | 60 | 62 |
| Thickness of Intermediate layer (mm) | 1 | 1 | 1 | 1 | 1 | 0.5 | 1.5 | 1 | 1 | 1 | 1 |
| Type of cover | A | A | A | A | A | A | A | B | A | A | A |
| Thickness of cover (mm) | 1.4 | 1.4 | 1.4 | 1.4 | 1.4 | 1.4 | 1.4 | 1.4 | 1.4 | 1.4 | 1.4 |
| Porperty | — | — | — | — | — | — | — | — | — | — | — |
| Deformation amount (mm) | 3.3 | 3.3 | 3.3 | 3.3 | 3.2 | 3.3 | 3.2 | 3.3 | 3.3 | 3.3 | 3.1 |
| Durability(times) | 205 | 184 | 190 | 189 | 182 | 200 | 199 | 208 | 180 | 180 | 161 |
| Flight distance (m) | 242 | 238 | 239 | 243 | 240 | 238 | 238 | 241 | 236 | 236 | 237 |
| Shot feeling | E | E | E | E | E | E | G | E | E | E | P |

The golf balls No. 1 to No. 8 are the golf balls comprising a core, an intermediate layer covering the core and a cover covering the intermediate layer, wherein the intermediate layer comprises a 3-dimensional shaped metal oxide having at least three needle-shaped parts and has the slab hardness of 55 D or more in Shore D hardness. All of the golf balls were excellent in the durability, flight distance, and shot feeling.

The intermediate layer compositions A to E used for the golf balls No. 1 to No. 8 satisfy the equation: $Y \geqq 18X-850$ and thus have high bending rigidity for the slab hardness thereof. Golf ball No. 9 is a conventional golf ball of which the intermediate layer does not contain a filler (reinforcing material). If comparing the golf balls No. 1 and No. 8 with the golf ball No. 9, it is apparent that the durability and the flight distance of the golf balls No. 1 and No. 8 are remarkably improved.

Golf ball No. 10 is the case that the intermediate layer contains the granular zinc oxide. The durability and the flight distance were not improved compared with Golf ball No. 9. Golf balls No. 11 is the case that the intermediate layer contains the filamental filler (reinforcing material). The flight distance was improved but the durability was lowered.

According to the preferable embodiment where the intermediate layer has the slab hardness of 55 D or more in shore D hardness, it is possible to provide the golf ball that is excellent in the durability and the flight performance (distance) without lowering the shot feeling.

The golf balls No. 12 to No. 17 are the golf balls comprising a core, an intermediate layer covering the core and a cover covering the intermediate layer, wherein the intermediate layer comprises a 3-dimensional shaped metal oxide having at least three needle-shaped parts and has the slab hardness of less than 55 D in Shore D hardness. All of the golf balls were excellent in the durability, flight distance, and controllability. The intermediate layer compositions I to N used for the golf balls No. 12 to No. 17 satisfy the equation: $(Ym/Xm)/(Yr/Xr) \geqq 1.05$ and thus have high bending rigidity for the slab hardness thereof. Golf ball No. 18 is a conventional golf ball of which the intermediate layer does not contain a filler (reinforcing material). Golf ball No. 19 is the case that the intermediate layer contains the 3-dimensional shaped metal oxide but has the slab hardness of 59 D. The durability of the golf ball was improved but the shot feeling was slightly lowered. Golf ball No. 20 is the case that the cover layer contains the granular zinc oxide. The durability and the flight distance were not improved and the shot feeling was deteriorated. Golf balls No. 21 to No. 23 are the cases that the intermediate layer contains the filamental filler (reinforcing material). Golf ball No. 24 is the case that the intermediate layer contains the nano composite. In any case, the durability, the flight distance and the shot feeling were not improved so much.

According to the preferable embodiment where the intermediate layer has the slab hardness of less than 55 D, it is

TABLE 7

| | Golf ball No. | | | | | | | | | | | | |
|---|---|---|---|---|---|---|---|---|---|---|---|---|---|
| | No. 12 | No. 13 | No. 14 | No. 15 | No. 16 | No. 17 | No. 18 | No. 19 | No. 20 | No. 21 | No. 22 | No. 23 | No. 24 |
| Structure | — | — | — | — | — | — | — | — | — | — | — | — | — |
| Type of core | 4 | 4 | 4 | 4 | 4 | 4 | 4 | 4 | 4 | 4 | 4 | 4 | 4 |
| Type of Intermediate layer | I | J | K | L | M | N | O | R | S | T | U | V | W |
| Slab hardness (Shore D) of | 40 | 48 | 40 | 40 | 40 | 41 | 40 | 59 | 42 | 42 | 42 | 42 | 42 |
| Thickness of Intermediate layer (mm) | 1 | 1 | 1 | 1 | 1 | 1 | 1 | 1 | 1 | 1 | 1 | 1 | 1 |
| Type of cover | C | C | C | C | C | C | C | C | C | C | C | C | C |
| Thickness of Cover (mm) | 1.3 | 1.3 | 1.3 | 1.3 | 1.3 | 1.3 | 1.3 | 1.3 | 1.3 | 1.3 | 1.3 | 1.3 | 1.3 |
| Property | — | — | — | — | — | — | — | — | — | — | — | — | — |
| Deformation amount (mm) | 3.4 | 3.1 | 3.4 | 3.4 | 3.4 | 3.4 | 3.4 | 2.8 | 3.4 | 3.3 | 3.3 | 3.3 | 3.3 |
| Durability(times) | 135 | 120 | 126 | 129 | 132 | 130 | 120 | 125 | 120 | 125 | 123 | 124 | 124 |
| Flight distance (m) | 243 | 244 | 242 | 242 | 243 | 243 | 240 | 239 | 240 | 241 | 241 | 241 | 241 |
| Shot feeling | E | E | E | E | E | E | E | F | G | G | G | G | G |

possible to provide the golf ball that is excellent in the durability, the flight performance (distance), and the shot feeling.

This application is based on Japanese Patent applications No.2,005-245,017 and No.2,005-245,018 filed on Aug. 25, 2005, the contents of which are hereby incorporated by reference.

What is claimed is:

1. A golf ball comprising a core, an intermediate layer covering the core, and a cover covering the intermediate layer as an outermost layer, wherein the intermediate layer comprises a 3-dimensional shaped metal oxide having at least three needle-shaped parts.

2. The golf ball according to claim 1, wherein the 3-dimensional shaped metal oxide has a 3-dimensional shape wherein the at least three needle-shaped parts are joined to each other at the one end thereof and the other ends thereof extend in the different directions, respectively.

3. The golf ball according to claim 1, wherein the metal oxide has four needle-shaped parts and has a 3-dimensional shape wherein the four needle-shaped parts are joined at the one end thereof at about the center of a regular tetrahedron and the other ends extend towards about the corners of the regular tetrahedron, respectively.

4. The golf ball according to claim 1, wherein the metal oxide has the needle-shaped parts with an average length of from 5 μm to 50 μm.

5. The golf ball according to claim 1, wherein the metal oxide is zinc oxide.

6. A golf ball comprising a core, an intermediate layer, and a cover covering the intermediate layer as an outermost layer, wherein the intermediate layer comprises a 3-dimensional shaped metal oxide having at least three needle-shaped parts and has a slab hardness of less than 55 D in shore D hardness.

7. The golf ball according to claim 6, wherein the 3-dimensional shaped metal oxide has a 3-dimensional shape wherein the at least three needle-shaped parts are joined to each other at the one end thereof and the other ends thereof extend towards different directions, respectively.

8. The golf ball according to claim 6, wherein the metal oxide has four needle-shaped parts and has a 3-dimensional shape wherein the four needle-shaped parts are joined at the one end thereof at about the center of a regular tetrahedron and the other ends extend towards about the corners of the regular tetrahedron, respectively.

9. The golf ball according to claim 6, wherein the metal oxide has the needle-shaped parts with an average length of from 5 μm to 50 μm.

10. The golf ball according to claim 6, wherein the metal oxide is zinc oxide.

11. A golf ball comprising a core, an intermediate layer, and a cover covering the intermediate layer as an outermost layer, wherein the intermediate layer comprises a 3-dimensional shaped metal oxide having at least three needle-shaped parts and has a slab hardness of 55 D or more in shore D hardness.

12. The golf ball according to claim 11, wherein the 3-dimensional shaped metal oxide has a 3-dimensional shape wherein the at least three needle-shaped parts are joined to each other at the one end thereof and the other ends thereof extend in different directions, respectively.

13. The golf ball according to claim 11, wherein the metal oxide has four needle-shaped parts and has a 3-dimensional shape wherein the four needle-shaped parts are joined at the one end thereof at about the center of a regular tetrahedron and the other ends extend towards about the corners of the regular tetrahedron, respectively.

14. The golf ball according to claim 11, wherein the metal oxide has the needle-shaped parts with an average length of from 5 μm to 50 μm.

15. The golf ball according to claim 11, wherein the metal oxide is zinc oxide.

* * * * *